US007156401B2

(12) United States Patent
Merklein et al.

(10) Patent No.: US 7,156,401 B2
(45) Date of Patent: Jan. 2, 2007

(54) ELASTOMERIC GASKET IN GASKET WELL OF HEAT EXCHANGER

(75) Inventors: Brian A. Merklein, Hartford, WI (US); Joseph P. Anders, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 109 days.

(21) Appl. No.: 10/944,605

(22) Filed: Sep. 17, 2004

(65) Prior Publication Data

US 2006/0061044 A1 Mar. 23, 2006

(51) Int. Cl.
*F16J 15/02* (2006.01)

(52) U.S. Cl. ..... 277/641; 165/149

(58) Field of Classification Search ..... 277/628, 277/630, 637, 641, 642; 165/149, 173, 175
See application file for complete search history.

(56) References Cited

U.S. PATENT DOCUMENTS 3,113,615 A * 12/1963 Huggins ..... 165/149
4,289,507 A * 9/1981 Cadars et al. ..... 96/201
4,331,201 A * 5/1982 Hesse ..... 165/153
4,455,728 A * 6/1984 Hesse ..... 29/890.03
4,546,822 A * 10/1985 Tamura ..... 165/149
4,546,823 A * 10/1985 Melnyk ..... 165/149
4,649,628 A * 3/1987 Allemandou ..... 165/148
4,881,595 A * 11/1989 Damsohn et al. ..... 165/173
4,917,182 A * 4/1990 Beamer ..... 165/173
4,940,086 A * 7/1990 Stay ..... 165/173
4,971,145 A * 11/1990 Lyon ..... 165/173
5,031,924 A * 7/1991 Beatenbough et al. ..... 277/321
5,076,557 A * 12/1991 Beatenbough et al. ..... 277/312
5,172,761 A * 12/1992 Lyon ..... 165/173
5,195,582 A * 3/1993 Haase ..... 165/173
5,201,368 A * 4/1993 Kroetsch ..... 165/173
5,214,848 A * 6/1993 Lelievre ..... 29/890.053
5,238,059 A * 8/1993 Smith ..... 165/173
5,246,065 A * 9/1993 Huff ..... 165/173
5,490,560 A * 2/1996 Helms et al. ..... 165/173

(Continued)

FOREIGN PATENT DOCUMENTS

DE 42 43 495 A1 6/1994

*Primary Examiner*—Patricia L. Engle
*Assistant Examiner*—Gay Ann Spahn
(74) *Attorney, Agent, or Firm*—Wood, Phillips, Katz, Clark & Mortimer

(57) ABSTRACT

A gasket well/gasket combination (30) is provided, and may be particularly useful for use in a header/tank assembly (12) for a heat exchanger (10). The combination (30) includes a gasket well (32) defined by a base wall (36) and a side wall (38) extending upwardly from the base wall (36), with the side wall (38) including an upwardly opening slot (40) having a width (SW). The combination further includes an elastomeric gasket (34) shaped to be received in the gasket well (32) and compressed between the base wall (36) and a mating part to form a sealed connection. The gasket (34) includes a seal bead (50) and a locating feature (52) having a tab (62) extending outwardly from the seal bead (50) to a terminal end (64) of the tab (62), with the tab (62) having a transverse width that does not increase from the seal bead (50) to the terminal end (64). The transverse width is larger than the slot width (SW) with the tab (62) in an undeformed state. The gasket (34) is receivable in the gasket well (32) with the tab (62) pinched in the slot (40) across the transverse width to retain the gasket (34) in the gasket well (32).

23 Claims, 3 Drawing Sheets

U.S. PATENT DOCUMENTS 5,535,821 A * 7/1996 Potier ..... 165/173
5,662,162 A * 9/1997 Fukuoka et al. ..... 165/41
5,664,625 A * 9/1997 Letrange et al. ..... 165/173
5,899,267 A * 5/1999 Kroetsch et al. ..... 165/173
5,927,395 A * 7/1999 Damiani ..... 165/166
5,944,095 A * 8/1999 Fukuoka et al. ..... 165/173
5,979,546 A * 11/1999 Stolarski et al. ..... 165/173
6,082,446 A * 7/2000 Ahaus et al. ..... 165/173
6,296,051 B1 * 10/2001 Sahnoun et al. ..... 165/173
2002/0023734 A1 * 2/2002 Wagner ..... 165/81

* cited by examiner

ELASTOMERIC GASKET IN GASKET WELL OF HEAT EXCHANGER

FIELD OF THE INVENTION

This invention is directed generally to gaskets or seals and their associated gasket or seal channel, groove or well, and in more particular applications, to such structures as used in a header/tank assembly for a heat exchanger.

BACKGROUND OF THE INVENTION

It is common in certain heat exchanger constructions, such as radiators, to provide a header/tank assembly wherein an elastomeric seal or gasket is located in a receiving groove, channel or well in the header plate and then compressed between the header plate and the tank to seal the joint therebetween. One problem associated with such constructions is the failure mode sometimes referred to as gasket-out-of-well (GOW), wherein the gasket is not located properly in its receiving well and ultimately fails to seal the associated joint, thereby resulting in a leak. Often this condition occurs because the gasket rides up on an inner wall of the receiving well due to a short gasket condition and is visually undetectable in the assembled state of the tank/header assembly. There are a number of approaches to overcome this problem. One approach involves the use of a suitable gasket lubricant or seal compound to temporarily "glue" the gasket in its proper location during assembly. However, this approach is often not reliable. Another approach, shown in German Patent No. DE 42 43 495 A1, is to provide a locating tab on the gasket that is received in a slot formed in a side wall of the gasket well. While this approach may prove successful, there is always room for improvement.

SUMMARY OF THE INVENTION

In accordance with one feature of the invention, a gasket well/gasket combination is provided for use in a header/tank assembly for a heat exchanger. The combination includes a gasket well having a generally rectangular-shaped outline in one of a header plate and tank of the header/tank assembly. The gasket well is defined by a base wall and an outer side wall extending upward from the base wall. The outer side wall includes a pair of upwardly opening slots spaced from each other along the gasket well, with each of the slots having a slot width SW. The combination further includes an elastomeric gasket shaped to be received in the gasket well and compressed between the base wall and the other of the header plate and the tank to seal the tank to the header plate. The gasket includes a seal bead and a pair of locating features spaced from each other along the seal bead. Each of the locating features includes a tab extending outwardly from the seal bead to a terminal end of the tab, with the tab having a transverse width that does not increase from the seal bead to the terminal end and the transverse width being larger than the slot width SW with the tab in an undeformed state. The gasket is receivable in the gasket well in an installed state with each of the tabs pinched in a corresponding one of the slots across the transverse width to retain the gasket in the gasket well.

In one feature of the invention, one of the slots is located at a first corner of the gasket well and the other of the slots is located at another corner of the gasket well diagonally opposite the first corner. The locating features are positioned opposite from each other along the seal bead to correspond with the locations of the corners of the gasket well.

In one feature, each of the locating features further includes a shoulder portion located between the seal bead and the tab to abut the outer side wall adjacent the corresponding slot to properly locate the gasket within the gasket well with the gasket in the installed state.

As one feature of the invention, the transverse width of each of the tabs decreases from the shoulder portion to the terminal end.

According to one feature, the gasket is sized relative to the gasket well so that the seal bead is placed in tension in the installed state.

In one feature of the invention, the gasket further includes another pair of oppositely positioned locating features, each of the another pair of locating features having a tab extending outwardly from the seal bead to a terminal end of the tab. The tab has a transverse width that does not increase from the seal bead to the terminal end, with the transverse width being larger than the slot width SW with the tab in an undeformed state. The outer side wall further includes another pair of upwardly opening slots to receive the tabs of the another pair of locating features, with one of the another pair located at a third corner of the gasket well and the other of the another pair located at fourth corner of the gasket well diagonally opposite the third corner. Each of the another pair has the slot width SW.

In accordance with one feature of the invention, a gasket well/gasket combination is provided for use in a header/tank assembly for a heat exchanger. The combination includes a gasket well having a generally rectangular-shaped outline in one of a header plate and tank of the header/tank assembly. The gasket well is defined by a base wall and an outer side wall extending upward from the base wall. The outer side wall includes four upwardly opening slots, with each of the slots located at a corresponding corner of the gasket well and having a slot width SW. The combination further includes an elastomeric gasket shaped to be received in the gasket well and compressed between the base wall and the other of the header plate and the tank to seal the tank to the header plate. The gasket includes four locating features, with each of the locating features having a shoulder portion and a tab extending outwardly from the shoulder portion to a terminal end of the tab. Each of the tabs has a transverse width that does not increase from the shoulder portion to the terminal end, with the transverse width being larger than the slot width SW with the tab in an undeformed state. The gasket is receivable in the gasket well in an installed state with each of the tabs pinched in a corresponding one of the slots across the transverse width and the shoulder portions abutted against the outer side wall adjacent the corresponding slot to properly locate the gasket within the gasket well.

According to one feature, each of the tabs is tapered from the shoulder portion to the terminal end.

In one feature of the invention, a gasket well/gasket combination is provided for use with a mating part to form a sealed connection. The combination includes a gasket well defined by a base wall and a side wall extending upward from the base wall, the side wall including an upwardly opening slot having a slot width SW. The combination further includes an elastomeric gasket shaped to be received in the gasket well and compressed between the base wall and the mating part to form the sealed connection. The gasket includes a locating feature having a shoulder portion and a tab extending outwardly from the shoulder portion to a terminal end of the tab. The tab has a transverse width that does not increase from the shoulder portion to the terminal end, with the transverse width being larger than the slot width SW with the tab in an undeformed state. The gasket is receivable in the gasket well with the tab pinched in the slot and the shoulder portion abutted against the side wall adjacent the slot to properly locate the gasket within the gasket well.

According to one feature, the gasket further includes at least one more locating feature having a shoulder portion and a tab extending outwardly from the shoulder portion to a terminal end of the tab, with the tab having a transverse width that does not increase from the shoulder portion to the terminal end. The transverse width is larger than the slot width SW with the tab in an undeformed state. The side wall further includes at least one more upwardly opening slot having the slot width SW to receive the tab of the at least one more locating feature.

In accordance with one feature of the invention, a gasket well/gasket combination is provided for use with a mating part to form a sealed connection. The combination includes a gasket well defined by a base wall and a side wall extending upward from the base wall, with the side wall including an upwardly opening slot having a slot width SW. The combination further includes an elastomeric gasket shaped to be received in the gasket well and compressed between the base wall and the mating part to form the sealed connection. The gasket includes a seal bead and a locating feature having a tab extending outwardly from the seal bead to a terminal end of the tab, with the tab having a transverse width that does not increase from the seal bead to the terminal end. The transverse width is larger than the slot width SW with the tab in an undeformed state. The gasket is receivable in the gasket well with the tab pinched in the slot to retain the gasket in the gasket well.

In one feature, the gasket further includes at least one more locating feature having a tab extending outwardly from the seal bead to a terminal end of the tab, with the tab having a transverse width that does not increase from the seal bead to the terminal end. The transverse width is larger than the slot width SW with the tab in an undeformed state. The side wall further includes at least one more upwardly opening slot having the slot width SW to receive the tab of the at least one more locating feature.

Other objects, features, and advantages of the invention will become apparent from a review of the entire specification, including the appended claims and drawings.

DETAILED DESCRIPTION OF THE PREFERRED EMBODIMENTS

Figure 1:
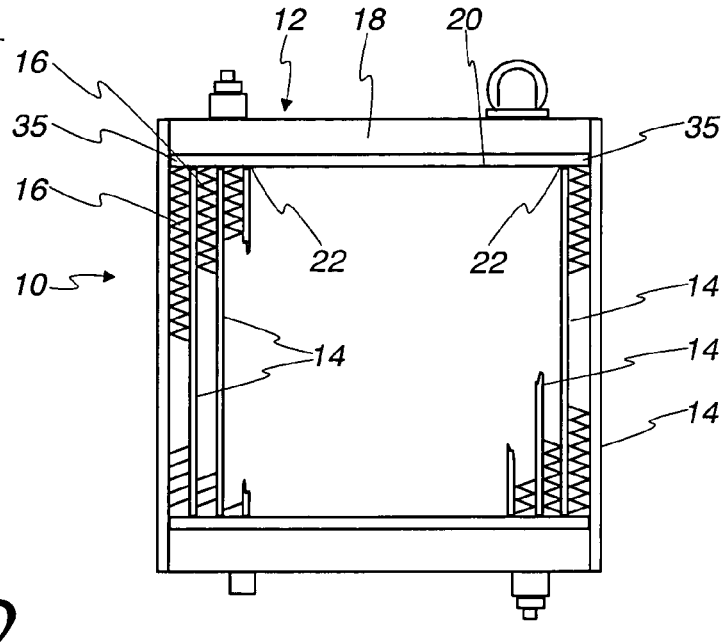
FIG. 1 is an elevation view of a heat exchanger having a header/tank assembly including a gasket well/gasket combination embodying the present invention.

With reference to FIG. 1, a heat exchanger 10 is shown and includes a header/tank assembly 12 that collects and/or distributes a working fluid to the interior of a plurality of heat exchanger tubes 14 that transfer heat to a second fluid flowing through fins 16 extending between the tubes 14. The assembly 12 includes a tank 18 and a rectangular-shaped header plate 20 that includes a plurality of tubes slots 22 that sealingly receive the ends of the tubes 14. It should be appreciated that while the gasket well/gasket combinations embodying the present invention are described herein in connection with use in the heat exchanger 10 and are particularly useful in such constructions, combinations embodying the present invention may find use in many other applications requiring a sealed joint, including non-heat exchanger applications and heat exchanger applications other than the heat exchanger construction 10 shown in FIG. 1. Accordingly, no limitation to use with a heat exchanger or to use with a particular type of heat exchanger construction is intended unless expressly recited in the appended claims.

Figure 2:
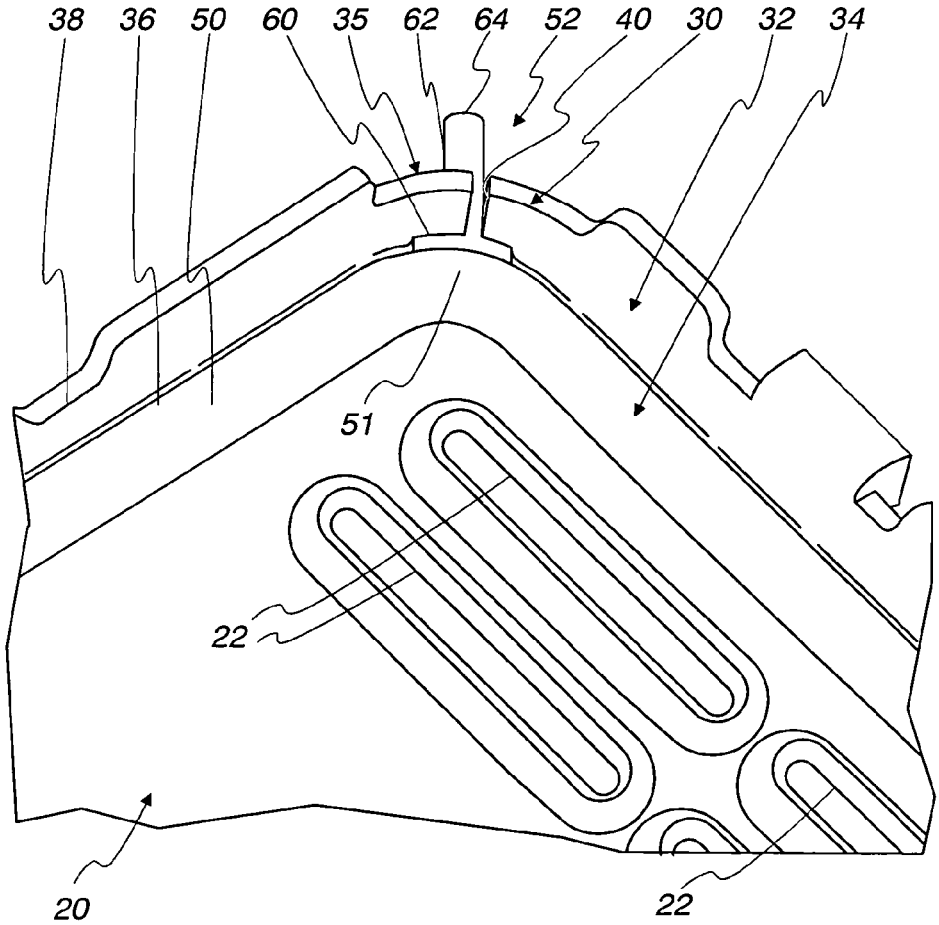
FIG. 2 is a perspective view of the header plate of the heat exchanger of FIG. 1 including a gasket well/gasket combination embodying the present invention.

With reference to FIG. 2, the interior side of the header plate 20 is shown and includes a gasket well/gasket combination 30 embodying the present invention. The combination 30 includes a gasket well 32 and an elastomeric gasket 34 shaped to be received in the gasket well 32. It should be understood that as used herein, the term "gasket well" is intended to broadly refer to any structure, including gasket channels and grooves, adapted to receive a seal or gasket in order to form a sealed joint or connection between two assembled pieces. It should also be understood that as used herein, the term "elastomeric gasket" is intended to broadly refer to any elastic seal or gasket that is adapted to be received in a gasket well to form a sealed joint or connection between two assembled pieces.

While the combination 30 is shown on the header plate 20 with the gasket well 32 being formed thereon, it should be understood that in some applications it may be desirable for the combination 30 to be on the tank with the gasket well 32 formed thereon.

Figure 3:
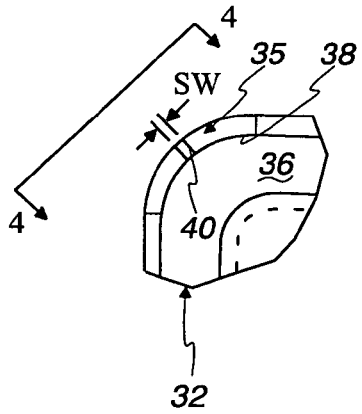
FIG. 3 is a plan view of one corner of the gasket well shown in FIG. 2.
Figure 4:
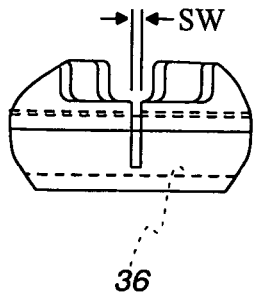
FIG. 4 is a view taken from line 4—4 in FIG. 3.

With reference to FIGS. 2–4, the gasket well 32 has generally rectangular-shaped outline with four corners 35 (only one shown in FIG. 2) and includes a planar base wall 36 and an outer or peripheral side wall 38 extending upward from the base wall 36. The side wall 38 includes four upwardly opening slots 40 (only one shown in FIG. 2 and FIG. 6), with one of the slots being located at each corner 35 (again only one shown in FIGS. 2 and 6) of the gasket well 32. As best seen in FIG. 4, each of the slots 40 has a slot width SW.

Figure 5:
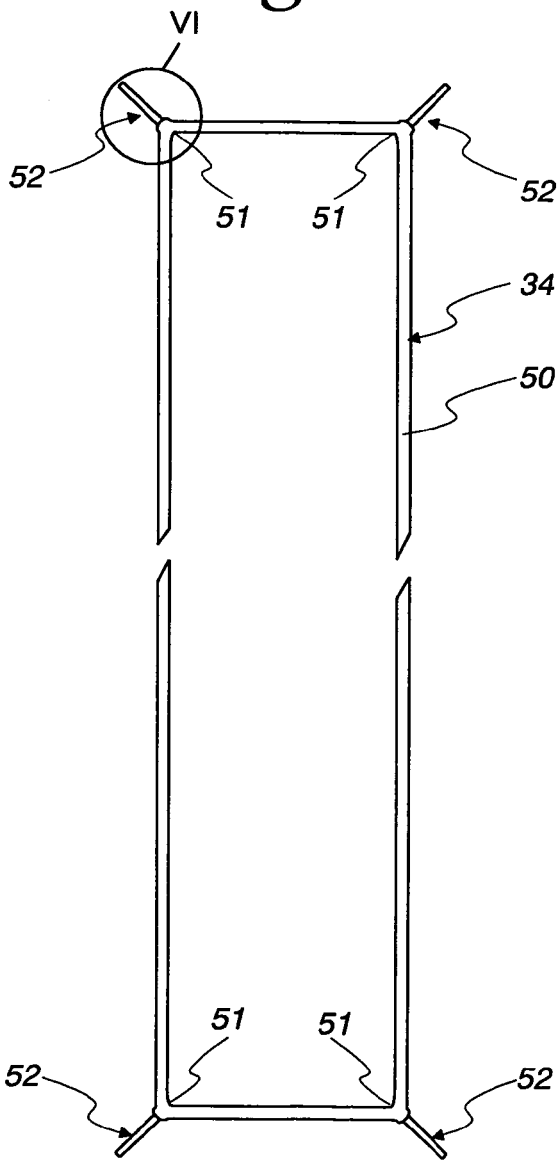
FIG. 5 is a plan view of the gasket of FIG. 2.

The elastomeric gasket 34 is shaped to be received in the gasket well 32 and compressed between the base wall 36 and a mating part, such as the tank 18 to form a sealed assembly or joint. As best seen in FIG. 5, the gasket 34 includes a seal bead 50 defining a generally rectangular-shaped outline with four corners 51 that conform to the rectangular-shaped outline of the gasket well 32. The gasket further includes four locating features 52, with one of the features 52 located at each of the corners 51 of the gasket 34. It is the seal bead 50 that is compressed between the base wall 36 and a mating part, such as the tank 18, to form a sealed joint. While the seal bead 50 may take many suitable shapes and forms, in the illustrated embodiment, the seal bead 50 is cylindrical with a nominally circular cross section. However, it should be understood, that in other applications, other shapes and/or cross sections for the seal bead 50 may be desired, many of which are well known.

Figure 6:
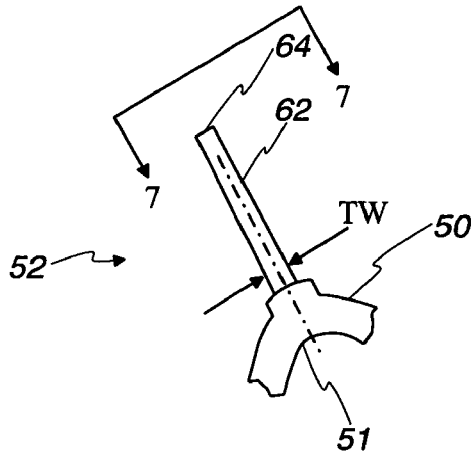
FIG. 6 is an enlarged view of the area encircled by line VI in FIG. 5.
Figure 7:
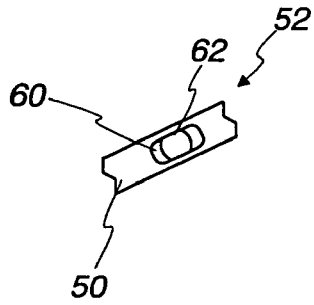
FIG. 7 is a view taken from line 7–7 in FIG. 6.

As best seen in FIGS. 6 and 7, each of the locating features 52 preferably includes a shoulder portion 60 and a tag or tab 62 extending outwardly from the shoulder portion 60 to a terminal end 64 of the tab 62. The tab 62 has a transverse width TW that does not increase from the shoulder portion 60 to the terminal end 64, and preferably the tab 62, including the transverse width TW, is tapered from the shoulder portion 60 to the terminal end 64 so as to slightly decrease as shown in FIG. 6. The transverse width TW is larger than the slot width SW with the tab 62 in an undeformed state such as the state shown in FIGS. 5–7.

Returning to FIG. 2, the gasket 34 is received in the gasket well 32 in an installed state shown in FIG. 2 with each of the tabs 62 pinched in a corresponding one of the slots 40 across the transverse width TW with the shoulder portion 60 abutted against the side wall 38 adjacent the slot 40. The gasket 34 can be assembled into the installed state by placing the gasket 34 into the gasket well 32 and then, for each locating feature 52, abutting the shoulder portion 60 against the side wall 38 while pulling on the tab 62 to stretch the same so as to reduce the transverse width TW and allow the tab 62 to be forced down into the slot 40 with the tab 62 pinched in the slot 40 across the transverse width TW. The pinching or interference fit between the tabs 62 and the slot 40 serves to retain the gasket 34 in the gasket well 32, while the abutment of the shoulder portions 60 against the side wall 38 serves to properly locate or center the gasket 34 within the gasket well 32. In this regard, it should be noted that another feature of the invention applies when the total length of the gasket seal bead 50 is less than the total length of the gasket well 32. In such a case, the ability of the tabs 62 to be pinched in the slots 40 allows for the gasket 34 to be put in tension. Indeed, it should be noted that any portion of the seal bead 50 can be put in tension if the length of the seal bead 50 between a pair of the locating features 52 is less than the length or distance between the corresponding slots 40 that will receive the locating features 52.

However, it should also be noted that in some applications it will be desirable for the gasket 34 to not be in tension in the installed state, i.e., for the seal bead 50 to be in its natural, unstretched shape when the tabs 62 are pinched in the slots 40 with the gasket 34 in the gasket well 32.

One advantage of the gasket 34 can best be seen in FIG. 5 wherein each of the locating features 52, including each of their shoulder portions 60 and tabs 62 extend outwardly from the seal bead 50 in a generally radial direction, with the shoulder portions 60 and tabs 62 having transverse widths that do not increase, or are preferably, slightly tapered such that the transverse widths decrease as they move radially outward. This construction advantageously allows the gasket 34 to be formed by a so-called mandrel molding method wherein the pull direction for the mold dies is radial. It is believed, that in certain circumstances, the mandrel molding method may allow for a lower cost of manufacture for the gasket 34 in comparison to other molding methods, such as axial pull (in and out of page with respect to FIG. 5) injection or compression molding. However, advantageously, the construction is also compatible with other types of methods, including injection and compression molding wherein the pull direction of the dies may be axial (in and out of the page with respect to FIG. 5). In this regard, it should be noted that the construction of German Patent No. DE 42 43 495 A1 discussed in the Background section is not compatible with a mandrel molding method because it does not allow for a radial pull direction for the mold dies.

While it is preferred that each of the locating features 52 include the shoulder portion 60 to ensure proper location or centering of the seal bead 50 in the gasket well 32, it may be desirable in some applications for the shoulder portion 60 to be removed from some or all of the locating features 52. For example, in applications wherein the gasket well 32 does not allow for a lot of "play" in the location or centering of the seal bead 50, the shoulder portions 60 may not be required.

Figure 8:
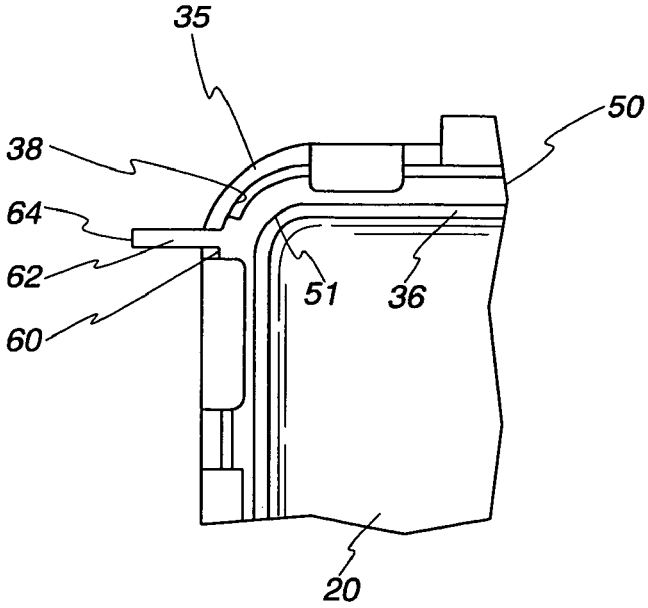
FIG. 8 is a plan view showing an alternate corner location for a tab and slot construction of a gasket well/gasket combination embodying the present invention.

It should also be appreciated that while the illustrated embodiment of the gasket well 32 and gasket 34 show rectangular-shaped outlines, the combination 30 can find use in any other shaped outline for the gasket well 32 and gasket 34, including but not limited to, any other polygonal shape, circular shapes, elliptical shapes, random shapes, and segments. Furthermore, it should be appreciated that while the gasket 34 is illustrated with a locating feature 52 and associated slot 40 located at each corner 35,51, there may be some applications wherein it may be desirable to have corners 35,51 of the combination that do not include a locating feature 52 and associated slot 40. For example, in the illustrated embodiment, in some applications it may be advantageous for the locating features 52 and associated slots 40 to be provided on only two diagonally opposite corners 51. Additionally, while the embodiments of the combination 30 illustrated in FIGS. 2–6 show the slot 40 and locating feature 52 centered on each of the corners (35,51), it may be advantageous for these features to be located at a different position on the corners 35,51, such as, for example the position shown in FIG. 8. Similarly, there may be some applications wherein it may be desirable for one or more of the locating features 52 and associated slot 40 to be on a straight or non-corner portion of the seal bead 50 and associated side wall 38.

It should be appreciated that the gasket well/gasket combinations 30 described herein can positively or properly locate the gasket 34 within the gasket well 32 because of the pinching or locking provided by the interaction between the locating features 52 and the associated slot 40. When applied to a header/tank assembly, the combination 30 can prevent the gasket 34 from pulling up and out of the gasket well 32 thus presenting the so-called GOW failure mode. Furthermore, because the tabs 62 protrude outside of the header plate 20, the tabs 62 can provide a visual indication that the gasket 34 is properly installed even after the tank 18 is assembled to the header plate 20 and the header/tank assembly 12 is assembled to the tubes 14 and fins 16.

The invention claimed is:

1. A gasket well/gasket combination for use in a header/tank assembly for a heat exchanger, said combination comprising:

a gasket well having a generally rectangular-shaped outline in one of a header plate and tank of said header/tank assembly, said gasket well defined by a base wall and an outer side wall extending upward from the base wall, said outer side wall including a pair of upwardly opening slots, one of said slots located at a first corner of said gasket well, the other of said slots located at another corner of said gasket well diagonally opposite said first corner, each of said slots having a slot width (SW); and an elastomeric gasket shaped to be received in said gasket well and compressed between said base wall and the other of said header plate and said tank to seal said tank to said header plate, said gasket including a seal bead and a pair of oppositely positioned locating features, each of said locating features including a tab extending outwardly from said seal bead to a terminal end of said tab, said tab having a transverse width that does not increase from the seal bead to the terminal end, said transverse width being larger than said slot width (SW) with the tab in an undeformed state, said gasket receivable in said gasket well in an installed state with each of said tabs pinched in a corresponding one of said slots across said transverse width to retain said gasket in said gasket well.

2. The combination of claim 1 wherein each of said locating features further comprises a shoulder portion located between the seal bead and the tab to abut the outer side wall adjacent the corresponding slot to properly locate the gasket within said gasket well with the gasket in the installed state.

3. The combination of claim 2 wherein the transverse width of each of said tabs decreases from the shoulder portion to the terminal end.

4. The combination of claim 1 wherein each of said tabs is tapered.

5. The combination of claim 1 wherein the gasket is sized relative to the gasket well so that the seal bead is placed in tension in said installed state.

6. The combination of claim 1 wherein:

said gasket further includes another pair of oppositely positioned locating features, each of said another pair of locating features having a tab extending outwardly from the seal bead to a terminal end of said tab, said tab having a transverse width that does not increase from the seal bead to the terminal end, said transverse width being larger than said slot width (SW) with the tab in an undeformed state; and the outer side wall further includes another pair of upwardly opening slots to receive said tabs of said another pair of locating features, one of said another pair located at a third corner of said gasket well, the other of said another pair located at fourth corner of said gasket well diagonally opposite said third corner, each of said another pair having said slot width (SW).

7. A gasket well/gasket combination for use in a header/tank assembly for a heat exchanger, said combination comprising:

a gasket well having a generally rectangular-shaped outline in one of a header plate and tank of said header/tank assembly, said gasket well defined by a base wall and an outer side wall extending upward from the base wall, said outer side wall including a pair of upwardly opening slots spaced from each other along the gasket well, each of said slots having a slot width (SW); and an elastomeric gasket shaped to be received in said gasket well and compressed between said base wall and the other of said header plate and said tank to seal said tank to said header plate, said gasket including a seal bead and a pair of locating features spaced from each other along the seal bead, each of said locating features including a tab extending outwardly from said seal bead to a terminal end of said tab, said tab having a transverse width that does not increase from the seal bead to the terminal end, said transverse width being larger than said slot width (SW) with the tab in an undeformed state, said gasket receivable in said gasket well in an installed state with each of said tabs pinched in a corresponding one of said slots across said transverse width to retain said gasket in said gasket well.

8. The combination of claim 7 wherein each of said locating features further comprises a shoulder portion located between the seal bead and the tab to abut the outer side wall adjacent the corresponding slot to properly locate the gasket within said gasket well with the gasket in the installed state.

9. The combination of claim 8 wherein the transverse width of each of said tabs decreases from the shoulder portion to the terminal end.

10. The combination of claim 8 wherein:

said gasket further includes another pair of locating features, each of said another pair of locating features having a shoulder portion and a tab extending outwardly from the shoulder portion to a terminal end of said tab, said tab having a transverse width that does not increase from the shoulder portion to the terminal end, said transverse width being larger than said slot width (SW) with the tab in an undeformed state; and the outer side wall further includes another pair of upwardly opening slots to receive said tabs of said another pair of locating features, each of said another pair having said slot width (SW).

11. The combination of claim 7 wherein the gasket is sized relative to the gasket well so that the seal bead is placed in tension in said installed state.

12. A gasket well/gasket combination for use in a header/tank assembly for a heat exchanger, said combination comprising:

a gasket well having a generally rectangular-shaped outline in one of a header plate and tank of said header/tank assembly, said gasket well defined by a base wall and an outer side wall extending upward from the base wall, said outer side wall including four upwardly opening slots, each of said slots located at a corresponding corner of said gasket well, each of said slots having a slot width (SW); and an elastomeric gasket shaped to be received in said gasket well and compressed between said base wall and the other of said header plate and said tank to seal said tank to said header plate, said gasket including four locating features, each of said locating features having a shoulder portion and a tab extending outwardly from the shoulder portion to a terminal end of said tab, said tab having a transverse width that does not increase from the shoulder portion to the terminal end, said transverse width being larger than said slot width (SW) with the tab in an undeformed state, said gasket receivable in said gasket well in an installed state with each of said tabs pinched in a corresponding one of said slots across said transverse width and said shoulder portions abutted against the outer side wall adjacent the corresponding slot to properly locate the gasket within said gasket well.

13. The combination of claim 12 wherein each of said tabs is tapered from the shoulder portion to the terminal end.

14. The combination of claim 12 wherein the gasket is sized relative to the gasket well so that the gasket is placed in tension in said installed state.

15. A gasket well/gasket combination for use with a mating part to form a sealed connection, said combination comprising:

a gasket well defined by a base wall and a side wall extending upward from the base wall, said side wall including an upwardly opening slot having a slot width (SW); and an elastomeric gasket shaped to be received in said gasket well and compressed between said base wall and said mating part to form said sealed connection, said gasket including a locating feature having a shoulder portion and a tab extending outwardly from the shoulder portion to a terminal end of said tab, said tab having a transverse width that does not increase from the shoulder portion to the terminal end, said transverse width being larger than said slot width (SW) with the tab in an undeformed state, said gasket receivable in said gasket well with said tab pinched in said slot across the transverse width and said shoulder portion abutted against the side wall adjacent the slot to properly locate the gasket within said gasket well.

16. The combination of claim 15 wherein the transverse width of said tab decreases from the shoulder portion to the terminal end.

17. The combination of claim 15 wherein:

said gasket further comprises at least one more locating feature having a shoulder portion and a tab extending outwardly from the shoulder portion to a terminal end of said tab, said tab having a transverse width that does not increase from the shoulder portion to the terminal end, said transverse width being larger than said slot width (SW) with the tab in an undeformed state; and said side wall further comprises at least one more upwardly opening slot having the slot width (SW) to receive the tab of said at least one more locating feature.

18. A gasket well/gasket combination for use with a mating part to form a sealed connection, said combination comprising:

a gasket well defined by a base wall and a side wall extending upward from the base wall, said side wall including an upwardly opening slot having a slot width (SW); and an elastomeric gasket shaped to be received in said gasket well and compressed between said base wall and said mating part to form said sealed connection, said gasket including a seal bead and a locating feature having a tab extending outwardly from the seal bead to a terminal end of said tab, said tab having a transverse width that does not increase from the seal bead to the terminal end, said transverse width being larger than said slot width (SW) with the tab in an undeformed state, said gasket receivable in said gasket well with said tab pinched in said slot across the transverse width to retain said gasket in said gasket well.

19. The combination of claim 18 wherein the transverse width of said tab decreases from the seal bead to the terminal end.

20. The combination of claim 18 wherein:

said gasket further comprises at least one more locating feature having a tab extending outwardly from the seal bead to a terminal end of said tab, said tab having a transverse width that does not increase from the seal bead to the terminal end, said transverse width being larger than said slot width (SW) with the tab in an undeformed state; and said side wall further comprises at least one more upwardly opening slot having the slot width (SW) to receive the tab of said at least one more locating feature.

21. The combination of claim 1 wherein the gasket is sized relative to the gasket well so that the seal bead is not placed in tension in the installed state.

22. The combination of claim 7 wherein the gasket is sized relative to the gasket well so that the seal bead is not placed in tension in the installed state.

23. The combination of claim 12 wherein the gasket is sized relative to the gasket well so that the seal bead is not placed in tension in the installed state.

* * * * *